US008439621B2

(12) United States Patent
Mueller

(10) Patent No.: US 8,439,621 B2
(45) Date of Patent: May 14, 2013

(54) DEVICE FOR SHAPING A BACK OF A BOOK COVER THAT IS ALIGNED WITH A BOOK BLOCK SPINE

(75) Inventor: Hans Mueller, Lauda-Koenigshofen (DE)

(73) Assignee: Mueller Martini Holding AG, Hergiswil (CH)

( * ) Notice: Subject to any disclaimer, the term of this patent is extended or adjusted under 35 U.S.C. 154(b) by 361 days.

(21) Appl. No.: 12/952,942

(22) Filed: Nov. 23, 2010

(65) Prior Publication Data

US 2011/0123298 A1 May 26, 2011

(30) Foreign Application Priority Data

Nov. 23, 2009 (EP) ..... 09405201

(51) Int. Cl.
*B42C 7/00* (2006.01)

(52) U.S. Cl.
USPC ..... 412/17; 412/3

(58) Field of Classification Search ..... 412/3–5, 412/17, 19–23
See application file for complete search history.

(56) References Cited

U.S. PATENT DOCUMENTS

| | | | | |
|---|---|---|---|---|
| 2,640,208 | A * | 6/1953 | De Florez et al. | 412/22 |
| 3,201,810 | A | 8/1965 | Throp | |
| 3,398,038 | A | 8/1968 | Crawford | |
| 5,308,208 | A * | 5/1994 | Ranson | 412/3 |
| 5,868,539 | A | 2/1999 | Rathert | |
| 5,980,182 | A * | 11/1999 | Yen | 412/17 |
| 6,364,590 | B1 * | 4/2002 | Gayoso | 412/22 |
| 7,918,775 | B2 * | 4/2011 | Pohlmann | 412/17 |
| 2007/0036638 | A1 * | 2/2007 | Yoshie et al. | 412/19 |
| 2007/0092357 | A1 | 4/2007 | Muller | |
| 2007/0286705 | A1 * | 12/2007 | Sasamoto et al. | 412/3 |

FOREIGN PATENT DOCUMENTS

| | | | |
|---|---|---|---|
| DE | 1 436 086 | | 1/1969 |
| DE | 198 53 254 | A1 | 5/2000 |
| DE | 198 53 254 | A1 | 5/2000 |
| DE | 100 57 600 | A1 | 5/2002 |
| DE | 100 57 602 | A1 | 5/2002 |
| DE | 10 2006 033117 | A1 | 1/2008 |
| GB | 1 501 443 | A | 2/1978 |

OTHER PUBLICATIONS

European Search Report issued in European Application No. 09405147.1 dated Mar. 1, 2010.

(Continued)

*Primary Examiner* — Dana Ross
*Assistant Examiner* — Kyle Grabowski
(74) *Attorney, Agent, or Firm* — Venable LLP; Robert Kinberg

(57) ABSTRACT

A device for shaping a book cover back on the inside of a horizontally positioned, spread-out book cover and aligned approximately evenly distributed with a spine of book block. The device includes two opposite-arranged fold-forming rails that have longitudinal extension and a shaping tool that is movable towards the inside of the book cover back that faces the spine to lift the book cover back between the fold-forming rails to form a web on the book cover back. The shaping tool includes a tool bar having a top presenting a guide plane and two adjacent support bars that extend parallel to the fold-forming rails along the longitudinal extension. The support bars adjust a web width of the book cover back in a direction transverse to the longitudinal extension through a joint adjustment of the spacing between the support bars. The support bars are form-fittingly and frictionally positioned on the guide plane of the tool bar.

22 Claims, 6 Drawing Sheets

OTHER PUBLICATIONS

Libau/Heinze, "Industrial Bookbinding," ISBN 3-88013-596-7, Edition 2001, pp. 4.

United States Non-Final Office Action issued in U.S. Appl. No. 12/873,391 dated Jul. 23, 2012.

Liebau, Dieter et al., "Industrielle Buchbinderei" (Industrial Bookbinding), *Verlag Beruf + Schule 2nd Edition* ISBN 3-88013-596-7 (2.Auflage), 2001, pp. 1, 4, 5, 466, 467, 472, and 473.

European Search Report dated Nov. 23, 2009, directed to counterpart application No. EP 09405201. (5 pages).

* cited by examiner

DEVICE FOR SHAPING A BACK OF A BOOK COVER THAT IS ALIGNED WITH A BOOK BLOCK SPINE

CROSS-REFERENCE TO RELATED APPLICATION

This application claims the priority of European Patent Application No. EP 09405201.6, filed on Nov. 23, 2009, the subject matter of which is incorporated herein by reference.

BACKGROUND OF THE INVENTION

The invention relates to a device for shaping back of a horizontally positioned, spread out book cover which may be aligned approximately evenly distributed with a book block spine and, if applicable, may be provided on the inside with an insert. The device may consist of a shaping tool that can be moved toward the inside of the book cover back which may face the book block spine, to lift up the book cover back between two fold-forming rails that may be arranged opposite each other on the side, thereby forming a web on the back of the book cover, wherein the tool comprises two adjacent support bars extending parallel to the fold-forming rails and embodied to jointly change the distance between the bars to adjust the web width of the book cover back in a direction transverse to the longitudinal extension of the fold-forming rails.

Devices of this type are used with casing-in machines on book-production lines for shaping the back of a book cover. Following a preceding partial process during which bound book blocks are processed, in particular along the back, respectively one book cover and one book block are joined along the back in the casing-in machine before the unfinished book is compressed and folds are pressed in. The shaping of the book spine occurs while the book is conveyed along the path leading to the casing-in machine, as described and shown in German patent document DE 1,436,086 A. These steps are described in further detail on pages 466/467 and on pages 472/473 of the book entitled "INDUSTRIELLE BUCHBINDEREI" [Industrial Bookbinding] by Liebau/Heinze, 2$^{nd}$ Edition, ISBN 3-88013-596-7.

SUMMARY

It is an object of the present invention to create a device of the aforementioned type which is suitable for shaping book cover backs having different widths and which can be adjusted, re-adjusted and operated in a simple manner.

The above and other objects are accomplished according to one aspect of the invention wherein there is provided a device for shaping a book cover back on the inside of a horizontally positioned, spread-out book cover and aligned approximately evenly distributed with a spine of the book block, which, in one embodiment, includes two opposite-arranged fold-forming rails having a longitudinal extension; and a shaping tool that is movable towards the inside of the book cover back that faces the spine to lift the book cover back between the fold-forming rails to form a web on the book cover back, wherein the shaping tool comprises: a tool bar having a top presenting a guide plane, and two adjacent support bars that extend parallel to the fold-forming rails along the longitudinal extension, wherein the support bars are adapted to adjust a web width of the book cover back in a direction transverse to the longitudinal extension through a joint adjustment of the spacing between the support bars, and the support bars are form-fittingly and frictionally positioned on the guide plane of the tool bar.

According to another embodiment, an adjustment mechanism may be adapted to connect the support bars in the guide plane with respectively two drivers which may be spaced apart in longitudinal extension and can be driven eccentric, to rotate around a vertical axis.

Other and in part more complicated adjustment devices, for example spindle drives or worm drives and the like, can also be used for the proposed system.

BRIEF DESCRIPTION OF THE DRAWINGS

The present invention will be more readily understood from the following detailed description when read in conjunction with the accompanying drawings, in which.

DETAILED DESCRIPTION

FIGS. 1 to 3, 6 and 7 show devices 1, designed for shaping the back 7 of a book cover 2 that is positioned horizontally spread out for the shaping operation and is provided, if applicable, on the inside with an insert, also called a center strip, and is aligned approximately evenly distributed with a book block spine, wherein this book cover may include two book cover halves and a center portion that forms the book cover back 7. The back insert is arranged between the book cover halves, on the binding cover, and can consist of cardboard or waste paper. Further references to other book cover embodiments can be found in the German patent documents DE 10,057,600 and DE 10,057,602 or the aforementioned book entitled "Industrial Bookbinding."

Figure 1:
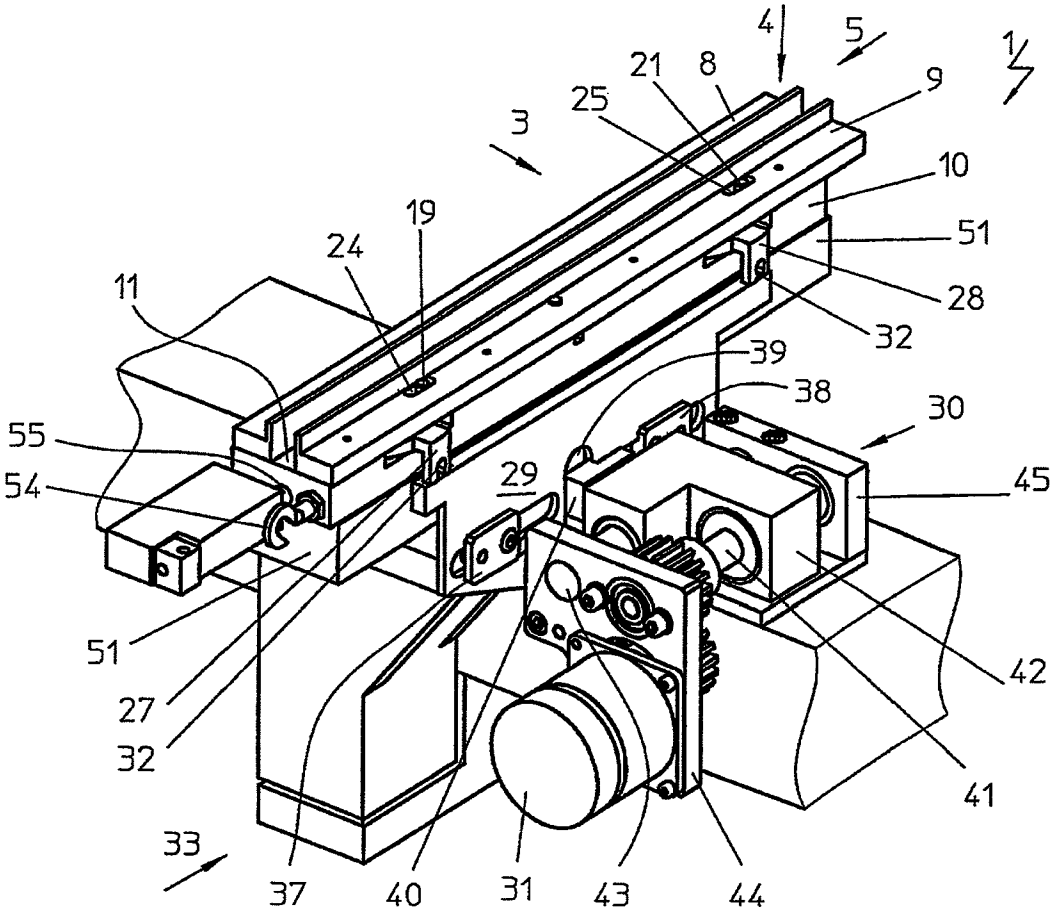
FIG. 1 is a three-dimensional representation of a device according to the invention, shown in the rest or adjustment position, according to an embodiment of the invention.
Figure 2:
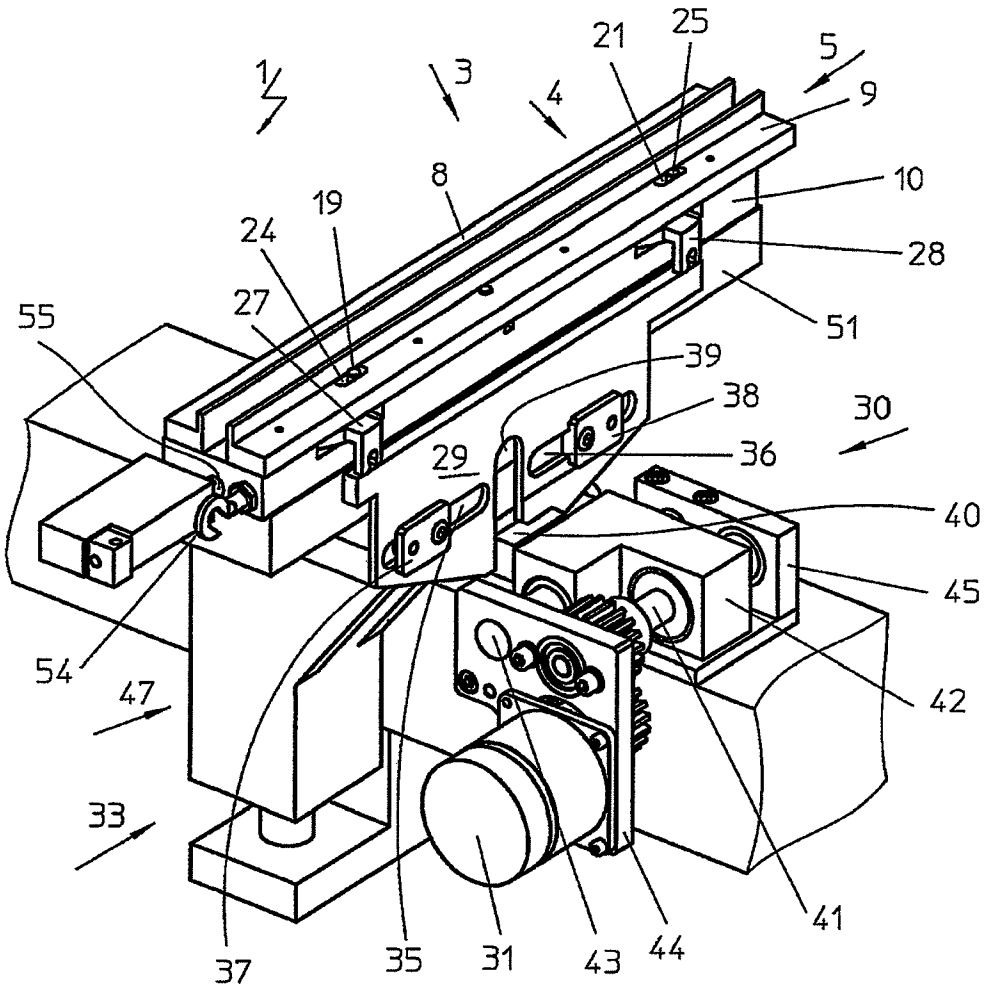
FIG. 2 is a three-dimensional representation of the device according to the invention, as shown in FIG. 1, in a position ready for shaping.
Figure 3:
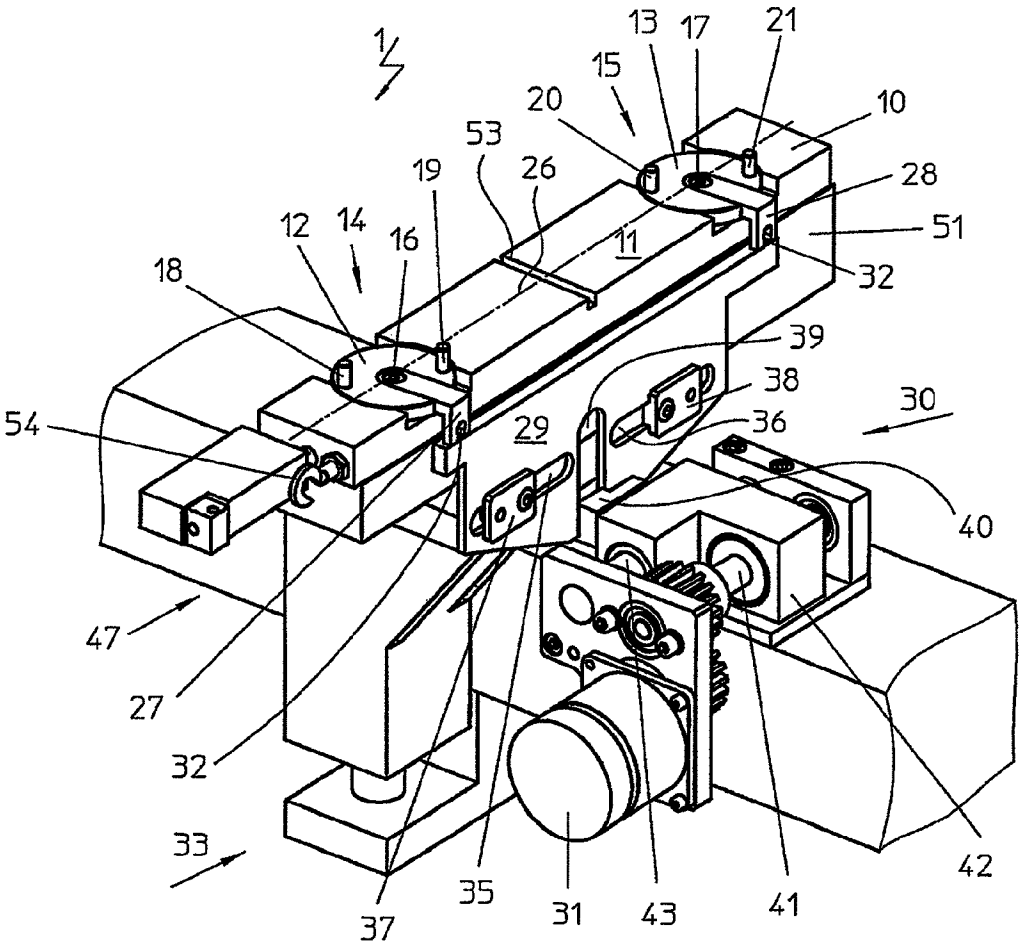
FIG. 3 is a three-dimensional representation of a shaping tool for the device shown in FIGS. 1 and 2, with the support bars removed and shown in a position ready for shaping.
Figure 6:
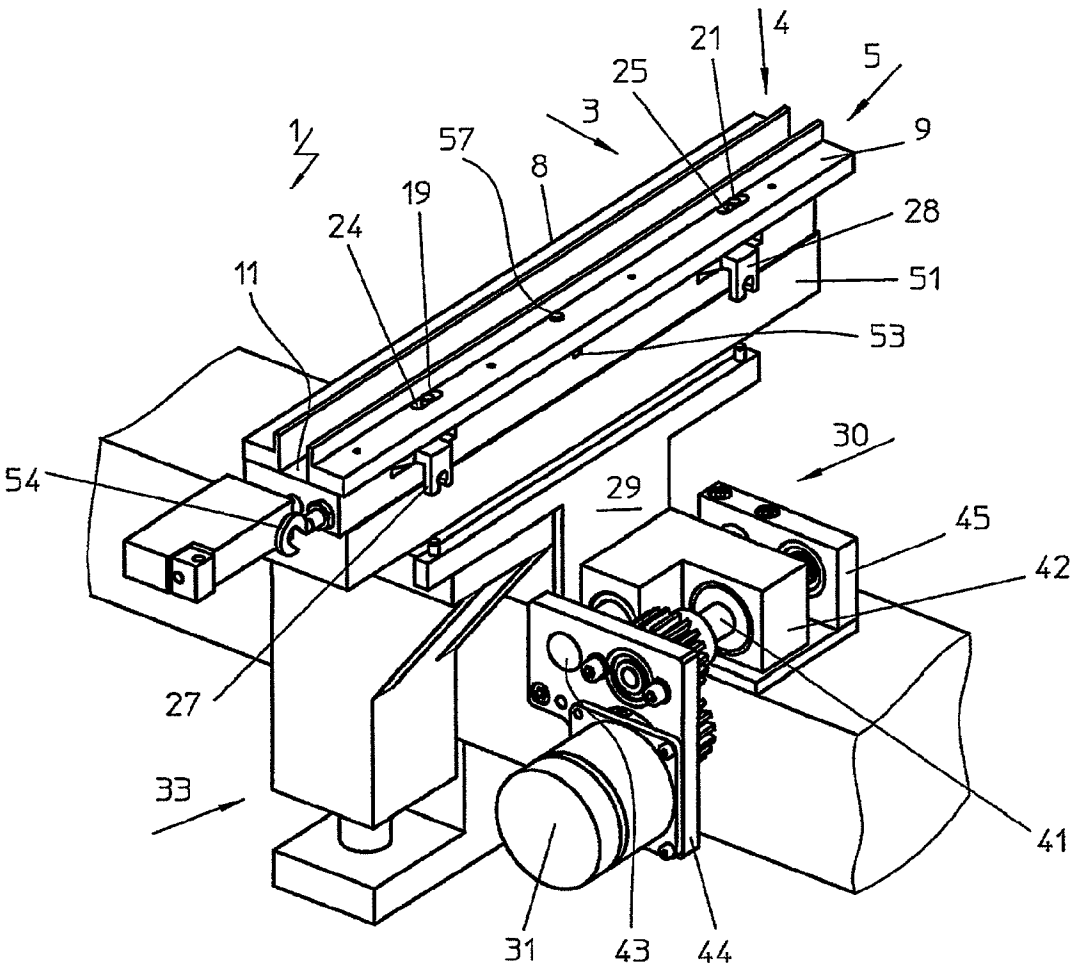
FIG. 6 is a three-dimensional representation of an alternative embodiment of a device according to an embodiment of the invention, with the shaping tool in a raised position.

FIG. 1 illustrates a device 1, according to an embodiment of the invention, in a starting, readiness or rest position in which a shaping tool 3, which is given the reference 3, is adjusted for a shaping operation, for example straight-back shaping. In the starting position, the shaping tool 3 which extends approximately over the length of a book height is located at a distance below a support plane 48 (see FIG. 7), used for shaping the back 7 of a book cover 2, which extends transverse to the direction for conveying the book blocks in a casing-in machine (e.g. see German patent document DE 1,436,086). The shaping tool 3, as part of the device 1, consists of two support bars 4, 5 that face each other and are positioned upright, respectively parallel, for raising the book cover back 7. The support bars 4, 5 are adjustable with respect to the spacing and form the width of a web 6 to be raised on the back 7 of a book cover. The support bars 4, 5 include base boards 8, 9 at the lower end, which rest on the side with an offset on a tool bar 10. The tool bar 10 has approximately the same length as the support bars 4, 5 and may exceed the width of the support bars for the greatest web width. In FIGS. 2, 3, and 6, the shaping tool 3 is shown in the lifted up position. A support surface 11, forms a guiding plane on the tool bar 10, and is provided with gliding properties for the support bars 4, 5, so that the base boards 8, 9, respectively the support bars 4, 5, can be displaced easily thereon.

According to FIG. 3, the tool bar 10 also functions to accommodate rotary bodies, for example disks 12, 13 which can be driven around vertical axes 16, 17 and are positioned inside spaced-apart recesses 14, 15 along the tool bar 10 and are provided on the top with drivers 18, 19; 20, 21 which are respectively arranged opposite each other relative to the rotational axis 16, 17. The disks 12, 13 are countersunk in the tool bar 10, such that they do not come in contact with the underside of the support bars 4, 5. The support bars 4, 5 are provided in the area of the base boards, parallel to the axis of rotation 16, 17 for the disks 12, 13, with through openings 24, or grooves through which the drivers 18, 19; 20, 21 extend at least partially, wherein the drivers 18, 19; 20, 21 can be embodied as stud bolts. To achieve an optimally effective, jointly counter-directed side lift of the support bars 4, 5, the drivers 18, 19; 20, in a starting position are aligned diametrically opposite a disk 12, 13, for example, at an angle of approximately 45° relative to a longitudinal or center longitudinal axis 26 of the tool bar 10, as shown in FIGS. 1 to 3 and 6. The rotary movements of the disks 12, 13 over an acute angle are achieved with a movement cam 27, 28 which is attached to the circumference of a disk 12, 13 and projects on the side over the tool bar 10 and with a pusher 29 of a pushing device 30 which may be connected to a drive cam 40. As a result, it is ensured that the distance between the support bars can be adjusted simultaneously and jointly. The distance can be adjusted or changed manually or with the aid of a motor.

A control unit that is connected to a (controllable) motor can also be used to increase the accuracy. Movement cams 27, 28 that project on one side over the tool bar 10 are connected via joints 32 or side guides to the pusher 29, which is attached to a frame 33, such that it can shuttle back and forth or can be moved back and forth. Through a joint rotating of the disks 12, 13, the drivers 18, 19; 20, 21 respectively move toward the inside or the outside and, in the process, reduce or enlarge the distance between the support rails 4, 5.

To prevent the support bars 4, 5 from being displaced, relative to each other, in longitudinal direction during the rotation of the disks 12, 13, a guide arrangement that extends transverse to the longitudinal extension of the support bars 4, 5 and the tool bar 10 is provided between the support rails 4, 5 and the tool bar 10, wherein this guide arrangement comprises, for example, a groove 53 in the tool bar 10 that extends transverse to the longitudinal extension of the aforementioned parts and, on the underside of the support bars 4, 5, a pin 57 or the like which engages in the groove 53 in the tool bar 10. It is thus ensured that the support bars 4, 5 can be adjusted exclusively in the direction transverse to the longitudinal extension of the shaping tool 3.

According to one embodiment, the shaping tool 3 may be replaceable, so that other types of support bars 4, 5 can also be used. The support bars 4, 5 of a shaping tool 3 can furthermore also be replaced. This type of design makes possible a quick replacement of the support bars 4, 5.

Suitable support rails 4, 5 which can have base boards 8, 9 that point either toward the inside or the outside can furthermore be installed on the tool bar 10. These options are available to ensure a universal use of the shaping device 1 if there are considerable differences in the web width.

Figure 7:
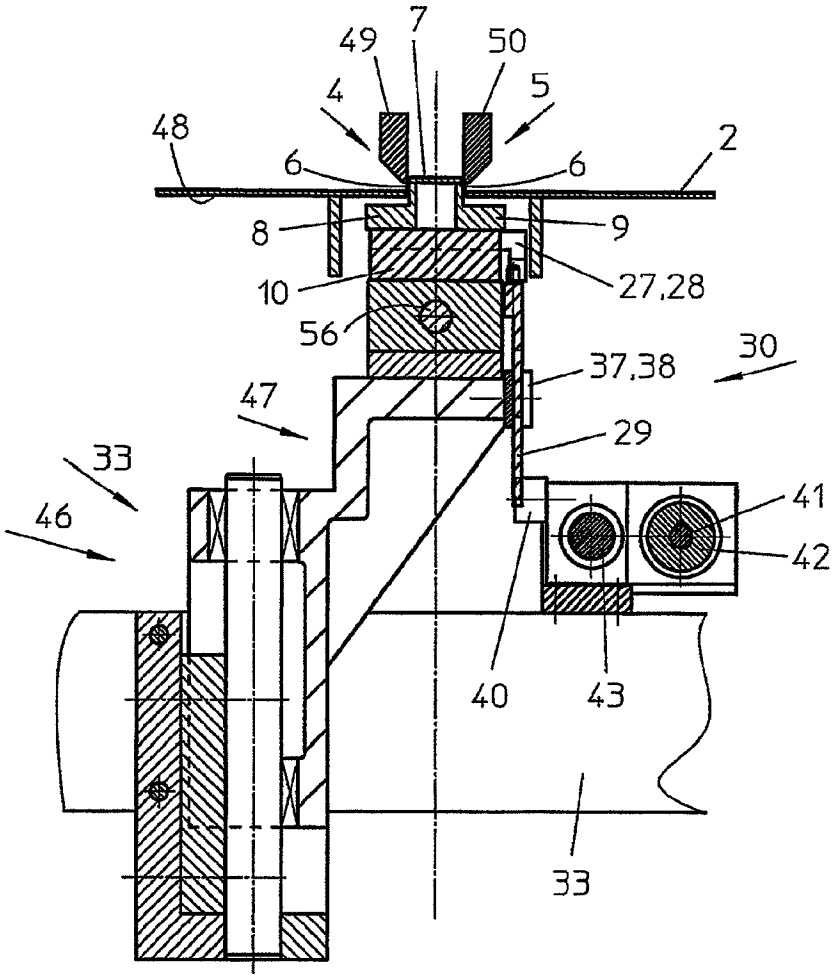
FIG. 7 depicts a cross-sectional view through the device in FIG. 2, with a shaped back for a book cover inserted into the device.

FIG. 7 shows the configuration with the shaping tool 3 which is also connected to the frame 33 and the pushing device 30, having a pusher 29 that is connected to the shaping tool 3, as shown for the embodiment in FIGS. 1 to 3. The pusher 29, which is drive-connected to the disks 12, 13 and extends flat in the downward direction, is provided with a guide arrangement in the flat area for displacing the pusher 29 parallel to the longitudinal extension of the tool bar 10. The guide arrangement is provided on one side with two elongated holes 35, 36 (see FIG. 2) which are spaced apart in the displacement direction and which extend in the latter direction. The guide arrangement, on the other side, is provided with respectively one sliding block 37, 38 that is attached to the frame 33 and is assigned to and submerged in the elongated holes 35, 36 for moving the pusher 29 back and forth. A slot-type opening 39, extending from the bottom toward the top, for a drive cam 40 embodied as driver is provided between the elongated holes 35, 36, wherein the drive cam is indirectly connected to the drive motor 31. The slot-type opening 39 makes it possible to raise or lower the shaping tool 3 connected to the frame 33. The embodiment shown in FIGS. 1 to 3 comprises a gear motor 31 with a drive shaft 41 embodied as a spindle which extends through and meshes with a spindle nut of an adjustment element 42 on which the drive cam 40 is mounted and which is guided on a rod 43 in the direction of the pushing movement of the pusher 29.

A bearing plate 44 and a bearing block 45 are provided for the positioning of the drive shaft 41, respectively the spindle. The selection of this adjustment device is based on the existing machine parts, wherein a rack and pinion gear could also be used for the adjustment device. For an alternative embodiment shown in FIG. 6, the disks 12, 13, respectively the movement cams 27, 28, are uncoupled from the pusher 29 when the shaping tool 3 is raised, meaning the pusher 29 which is fixedly connected to the adjustment element 42 does not change its position in the vertical direction.

The shaping tool 3 is lifted up from a rest or adjustment position with the aid of a piston-cylinder unit 46, shown in FIG. 7, which is attached to the frame 33 and which carries the shaping tool 3 on a console 47. As illustrated in FIG. 7, raising the shaping tool 3 causes the book cover back 7 to be pushed upward between two spaced-apart, respectively adjusted, fold-forming rails 49, 50 that are positioned opposite the support rails 4, 5, to form a fold that is shaped under the influence of heat. A separate hinge is thus formed in the border region between each book cover half and the back 7 for the book cover, respectively on the binding cover.

Figure 4:
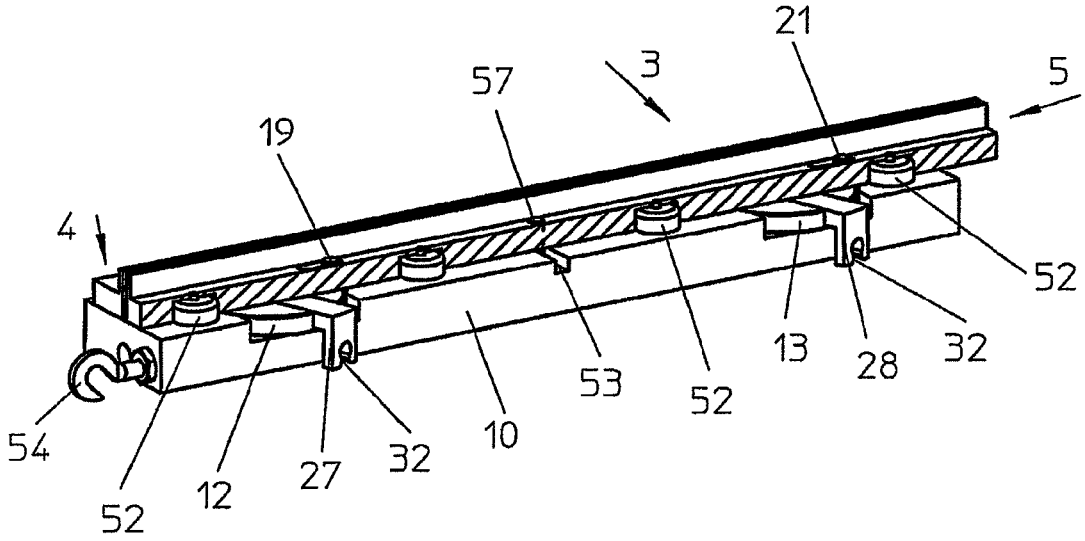
FIG. 4 depicts a detailed view of a three-dimensional representation of the shaping tool in a partial view/sectional view, according to an embodiment of the invention.
Figure 5:
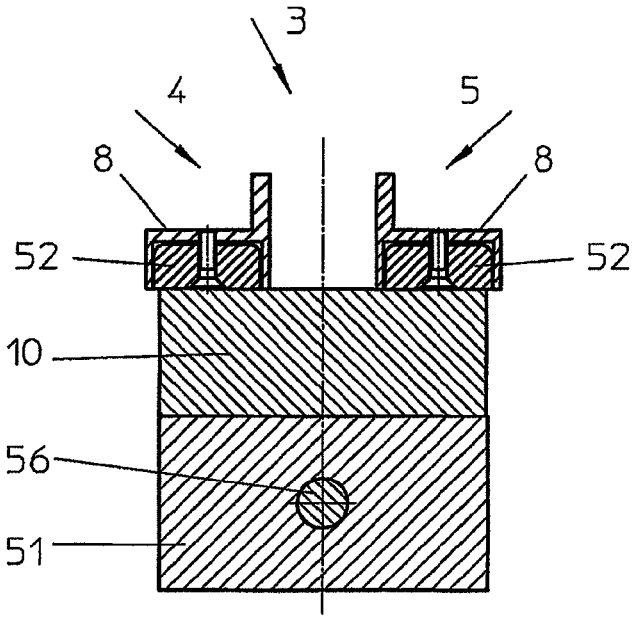
FIG. 5 is a cross-sectional view of the shaping tool, according to an embodiment of the invention.

FIGS. 4 and 5 show the embodiment of the shaping tool 3 with the aid of a partial view/longitudinal representation for a non-slip connection between the top 11 of the tool bar 10 which rests on an intermediate element 51, embodied here as a heating element. The support bars 4, 5, for example, can be provided with magnetic forces on their undersides for generating high forces of attraction, relative to the top of the iron-containing tool bar 10. In particular for the shaping operations, the support bars 4, 5 are provided on the underside with permanent magnets 52 that are distributed over the length of the base boards 8, 9, are button-shaped and are removably attached to the base boards 8, 9, for example by screwing them on or attaching them with adhesive. The magnetic surface of the permanent magnets 52 may be aligned flush with the underside of the support bars 4, 5, respectively the base boards 8, 9, wherein electro-magnets that can be switched on and off can also be used in place of the permanent magnets. Known permanent magnets are capable of resisting a temperature of up to 500° C.

Of course, it is also possible for an alternative embodiment to install permanent magnets 52 in the tool bar 10 for generating forces of attraction that act upon the support bars 4, 5.

In another embodiment, the support bars 4, 5 can be pressed via the base boards 8, 9 and with the aid of screws and compression springs against the tool bar 10, wherein the support bars 4, 5 may be screwed to displaceable sliding blocks which may be inserted into the tool bars 10.

A pull up hook 54 is visible in FIGS. 1 to 3 and 6 may be used for the installation or the removal of a shaping tool 3 from the device 1 with the aid of a lifting device.

For a precise positioning of the shaping tool 3, a cone-shaped positioning pin 55 can be provided, which is connected to the frame 33 and is snapped under pressure from a spring into a bore provided on the front of the tool bar 10.

For the shaping of the book cover back 7, the support bars 4, 5 are heated strongly from below. The intermediate element 51 which comprises heating rods is provided for this below the tool bar 10 and functions to transmit heat to the support bars 4, 5.

It will be understood that the above description of the present invention is susceptible to various modifications, changes and adaptations, and the same are intended to be comprehended within the meaning and range of equivalents of the appended claims.

What is claimed is:

1. A device for shaping a book cover back on the inside of a horizontally positioned, spread-out book cover aligned approximately evenly distributed with a spine of a book block, said device comprising:

two opposite-arranged fold-forming rails having a longitudinal extension; and a shaping tool that is movable towards the inside of the book cover back that faces the spine to lift the book cover back between the fold-forming rails to form a web on the book cover back, wherein the shaping tool comprises:

a tool bar having a top presenting a guide plane, and two adjacent support bars that extend parallel to the fold-forming rails along the longitudinal extension, wherein the support bars are adapted to adjust a web width of the book cover back in a direction transverse to the longitudinal extension through a joint adjustment of the spacing between the support bars, and the support bars are form-fittingly and frictionally positioned on the guide plane of the tool bar.

2. The device according to claim 1, further comprising a first and second pair of drivers, wherein two drivers, one from each of the first and second pair of drivers, are coupled to each support bar, and wherein the two drivers coupled to each support bar are arranged spaced apart in a longitudinal direction and are driven to rotate around first and second vertical axes, respectively.

3. The device according to claim 2, further comprising first and second rotatable disks that are respectively coupled to the first and second pair of drivers, wherein the first and second rotatable disks are adapted to rotate around the first and second vertical axes, respectively.

4. The device according to claim 3, wherein the drivers in each of the first and second pair of drivers are arranged on opposite sides of the first and second rotatable disks with respect to the first and second axes, respectively.

5. The device according to claim 3, wherein the first and second rotatable disks are positioned on the tool bar of the shaping tool.

6. The device according to claim 5, further comprising an intermediate element comprising a heating element on which the tool bar is arranged.

7. The device according to claim 3, further comprising a pushing device drive-connected to the first and second rotatable disks.

8. The device according to claim 7, wherein the first and second rotatable disks are separable from the pushing device by lifting up the tool bar.

9. The device according to claim 7, further comprising a spindle drive connected to the pushing device.

10. The device according to claim 7, wherein the pushing device is adjustable in a direction parallel to the longitudinal extension of the support bars.

11. The device according to claim 3, wherein the first and second rotatable disks are rotated by an acute angle around the first and second axis, respectively.

12. The device according to claim 3, further comprising a pusher, wherein the circumference of the first and second disks each respectively include a movement cam that is connected to the pusher.

13. The device according to claim 12, further comprising a spindle drive; and an adjustment element including a drive cam that is connected to the spindle drive, wherein the pusher is downward pointing and includes a vertically extending opening into which the drive cam projects.

14. The device according to claim 13, wherein the pusher is coupled to the adjustment element.

15. The device according to claim 1, wherein the top of the tool bar includes a support surface that defines the guide plane.

16. The device according to claim 15, wherein the support bars are frictionally or form-fittingly coupled to the support surface of the tool bar.

17. The device according to claim 16, further comprising a frame attached to the pushing device; and a pusher that is displaceable in the pushing device.

18. The device according to claim 1, wherein the support bars are coupled to the tool bar through magnetic forces.

19. The device according to claim 18, further comprising permanent magnets aligned along the longitudinal extension and flush along the underside of the support bars, wherein the permanent magnets include surfaces that magnetically exert an attraction upon the tool bar.

20. The device according to claim 1, wherein the support bars contain iron and the tool bar includes an at least partially magnetic surface that attracts the iron-containing support bars.

21. The device according to claim 1, further comprising a guide arrangement to adjust the support bars in a direction transverse to the longitudinal extension.

22. The device according to claim 21, wherein the guide arrangement comprises a guide groove that extends transverse to the longitudinal extension of the support bars in the tool bar, and wherein the guide groove is adapted to accommodate a guide wedge of the support bars.

* * * * *